US006550897B2

(12) United States Patent
Nakamura et al.

(10) Patent No.: US 6,550,897 B2
(45) Date of Patent: Apr. 22, 2003

(54) INKJET RECORDING HEAD AND RECORDING APPARATUS USING THE SAME

(75) Inventors: Hirofumi Nakamura, Tokyo (JP); Masakazu Okuda, Tokyo (JP); Yasuhiro Otsuka, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/022,938

(22) Filed: Dec. 18, 2001

(65) Prior Publication Data

US 2002/0075362 A1 Jun. 20, 2002

(30) Foreign Application Priority Data

Dec. 19, 2000 (JP) ..... 2000-385653
Sep. 28, 2001 (JP) ..... 2001-299781

(51) Int. Cl.[7] ..... B41J 2/045

(52) U.S. Cl. ..... 347/68; 347/70; 347/71; 310/328; 310/330

(58) Field of Search ..... 347/68, 70, 71; 310/328, 330

(56) References Cited

U.S. PATENT DOCUMENTS 5,513,431 A * 5/1996 Ohno et al. ..... 29/890.1
6,113,225 A * 9/2000 Miyata et al. ..... 347/70
6,290,341 B1 * 9/2001 Furuhata et al. ..... 347/70
2001/0040609 A1 * 11/2001 Furuhata et al. ..... 347/70
2002/0018095 A1 * 2/2002 Nakamura et al. ..... 347/40
2002/0051040 A1 * 5/2002 Shimada et al. ..... 347/71
2002/0149652 A1 * 10/2002 Sakamoto et al. ..... 347/68

FOREIGN PATENT DOCUMENTS

| | | |
|---|---|---|
| DE | 196 23 620 A1 | 12/1996 |
| DE | 695 10 108 T2 | 11/1999 |
| DE | 693 26 204 T2 | 3/2000 |
| EP | 0 925 923 A1 | 6/1999 |
| EP | 1 083 048 A1 | 3/2001 |
| JP | 11-078015 | 3/1999 |

* cited by examiner

*Primary Examiner*—Judy Nguyen
(74) *Attorney, Agent, or Firm*—Scully, Scott, Murphy & Presser

(57) ABSTRACT

An inkjet recording head allowing a high driving efficiency and preventing a variation in the driving efficiency is disclosed. An piezoelectric actuator is provided for each ink nozzle and has a driving section disposed in an area of an ink pressure chamber, an electrode pad section, and at least one bridge section connecting the driving section and the electrode pad section. The pressure chamber has a plane shape having an aspect ratio approximately equal to 1, and the bridge section has a width of a connection area to the driving section set smaller than a width of a connection side of the driving section.

29 Claims, 12 Drawing Sheets

INKJET RECORDING HEAD AND RECORDING APPARATUS USING THE SAME

BACKGROUND OF THE INVENTION

1. Field of the Invention

The present invention relates to an inkjet recording head and an inkjet recording apparatus for carrying out the recording of characters and images with jetted droplets of ink.

2. Description of the Related Art

An inkjet recording head is used for printing characters and images onto a sheet of recording paper or the like by adhering droplets of inks onto the paper. The droplets of ink are selectively jetted from a plurality of nozzles while reciprocally moving the head in the main scanning direction as well as moving the recording paper in a sub-scanning direction orthogonal to the main scanning direction. FIGS. 19 to 21 are diagrams showing a structure of a general inkjet recording head according to a conventional technique. FIG. 19 is a exploded perspective diagram, FIG. 20 is a cross-sectional diagram of a portion near one pressure chamber, and FIG. 21 is a top plan perspective diagram of a main portion (piezoelectric actuators and pressure chambers). As shown in FIG. 19 and FIG. 20, the inkjet recording head is constructed of a nozzle plate 21, a supply-path plate 22, a pressure chamber plate 23, and a diaphragm 4, which are laminated in this order. Based on these plates and the diaphragm, there are formed plural ink paths extending from an ink pool 10 to nozzles 1 via supply paths 11 and pressure chambers 2, respectively.

Specifically, the plural nozzles 1 for jetting droplets of ink are formed in one line on the nozzle plate 21 with piercing through this plate. On the supply-path plate 22, there is formed each of the supply paths 11 that connects between a corresponding pressure chamber 2 and the ink pool 10, and each of through-holes 12 that connects between a corresponding one of the pressure chambers 2 and a corresponding one of the nozzles 1. Each of the supply paths 11 and through-holes 12 pierces through the supply-path plate 22. The pressure chamber plate 23 has the single ink pool 10 and the pressure chambers 2 corresponding to the respective nozzles 1, formed with piercing through this pressure chamber 23. Piezoelectric actuators 5 are connected to the diaphragm 4 corresponding to the respective pressure chambers 2 by a conductive adhesive. Electrode films are provided on both sides of each piezoelectric actuator 5, and an electrode film on the free surface side functions as an individual electrode 9. The diaphragm 4 made of a metal material also works as an electrode common to each piezoelectric actuator 5.

As shown in FIG. 20 and FIG. 21, each piezoelectric actuator 5 is shaped like a plate having a constant width, and this consists of a driving section 6 and an electrode pad section 7. The driving section 6 is positioned in an area corresponding to a corresponding pressure chamber 2, and the electrode pad section 7 is positioned in an area corresponding to a side wall 3 of the pressure chamber 2.

An electrical connection (not shown) from an external driving circuit to the individual electrodes 9 is made by the electrode pad section 7. When a potential difference is applied as a driving signal between both electrodes (the individual electrodes 9 and the diaphragm 4) of a piezoelectric actuator 5, the driving section 6 of the piezoelectric actuator 5 and an area of the diaphragm 4 corresponding to this driving section 6 are deformed. As a result, the ink in a corresponding pressure chamber 2 is compressed, and a droplet of ink is jetted from the corresponding nozzle 1. When the deformation is larger, it becomes possible to increase the jetted volume of ink. After the droplets of ink has been jetted, the ink is replenished from the ink pool 10 to the corresponding pressure chamber 2 via the corresponding supply path 11.

An electrical connection to the individual electrode 9 by the electrode pad section 7 provided in the piezoelectric actuator 5 has an advantage that no wiring is needed to provide an electrical connection to the driving section 6. With this arrangement, it is possible to prevent a constraint in the flexure deformation and the occurrence of variation in the deformation, which would be developed by the wiring at the time of driving. Further, the electrical connection made by the electrode pad section has another advantage as follows. The electrode pad section is not destroyed even when excessive pressure is applied to the electrode pad section in the electrical connection process, as the electrode pad section is located on the side wall of the pressure chamber and has high rigidity. In other words, it is possible to prevent the inkjet apparatus from being destroyed due to flexure caused by applying pressure.

As shown in FIGS. 19 to 21, conventionally the plane view of the pressure chamber has a rectangular shape. This has two reasons. One is that it has been desired to make the pitch between the nozzles as narrow as possible (that is, to make the short side of a rectangular shorter) so as to achieve high-resolution printing. The other reason is that it has been desired to make the flexure area of the diaphragm as large as possible (that is, to increase the long side thereof as much as possible) so as to secure the volume of an ink droplet required for the high-resolution printing. The piezoelectric actuator is shaped like a rectangular shape having a constant width to match the pressure chamber that has a rectangular shape.

As explained above, conventionally, a high-resolution inkjet recording head has been realized in a simple structure, by using a pressure chamber having a rectangular plan shape.

In recent years, a high speed has also been required for the inkjet recording head. In order to realize high-speed inkjet recording, it is effective to increase the number of nozzles. This is because when the number of nozzles is larger, it becomes possible to increase the number of ink droplets (dots of an image) that can be formed on the recording paper per unit time.

However, when only the number of nozzles is increased, the total size of the head becomes larger, and this brings about a problem of increase in the manufacturing cost of the head. Therefore, in the case of increasing the number of nozzles, it is necessary to take into account how to dispose as large number of nozzles as possible within a constant head area. In other words, how to increase the density of nozzles becomes a most important issue.

The pressure chamber occupies most of the area of each nozzle. Therefore, in order to realize the improvement in the nozzle density, it becomes essential to reduce the plane area of each pressure chamber. When the area of the plane of the pressure chamber is reduced, the flexure deformation of the driving section is lowered. As a result, the volume of a jetted ink droplet becomes smaller, resulting in reduced density of printed characters and images.

In other words, in order to realize the high-speed inkjet printing it is essential to increase the flexure deformation of the driving section even if the plane area of the pressure chamber is reduced, that is, to increase the driving efficiency per unit area.

SUMMARY OF THE INVENTION

It is an object of the present invention to provide an inkjet recording head allowing a high driving efficiency per unit area.

It is another object of the present invention to provide an inkjet recording head capable of preventing a variation in the driving efficiency even when a position of a piezoelectric actuator has deviated.

It is still another object of the present invention to provide an inkjet recording head that has high precision and high reliability, which can be manufactured at low cost in a simplified manufacturing process.

In order to solve the above problems, the inventors have carried out analysis and research focusing attention on the plane shape of a pressure chamber. On the condition that pressure chambers having rectangular plane shapes of the same plane areas but having different aspect ratios (the ratio of height to width), we measured an amount of flexure deformation when these pressure chambers provided with diaphragms and piezoelectric actuators have been vibrated. FIG. 4 shows a result of the flexure deformation measurements. FIG. 4 also shows states of the flexure deformation of the piezoelectric actuators. In this case, an aspect ratio may be an index that shows a degree of plane shape flatness of the pressure chamber. Specifically, the aspect ratio is defined as B/A for each of shapes shown in FIG. 3. When this numerical value is large, this means that the pressure chamber has a slender plane shape. For example, the aspect ratio of an equilateral triangle is 0.866, the aspect ratio of a regular square is 1, the aspect ratio of a regular hexagon is 0.866, and the aspect ratio of a true circle is 1. Conditions for the analysis are as follows. The plane area of a pressure chamber is $2.5\times10^{-7}$ $m^2$. The thickness of a diaphragm is 10 $\mu$m. The material of the diaphragm is stainless steel SUS304. The thickness of an piezoelectric actuator is 30 $\mu$m. The material of the piezoelectric actuator is PZT. The shape of the piezoelectric actuator is the same as that of the pressure chamber (an electrode pad is not included). The driving voltage is 30 V.

It has been known from the result shown in FIG. 4 that an optimum aspect ratio of the pressure chamber is 1, in order to obtain a high driving efficiency per unit area. Based on this result, a more practical structure is assumed. An additional analysis has been carried out for the case where an electrode pad has been provided in the piezoelectric actuator. An electrode pad section of each shape has been provided on the short side of the plane shape of the pressure chamber.

FIG. 5 shows a result of this analysis. For the purpose of comparison, the result shown in FIG. 4 is also included in FIG. 5. It has become clear from FIG. 5 that the driving efficiency is lowered when the electrode pad is additionally provided. The amount of reduction depends on the aspect ratio. Particularly, such reduction is extreme when the pressure chamber has a structure having the aspect ratio close to 1. In other words, when the electrode pad is additionally provided, there arises a specific problem due to the shape having the aspect ratio close to 1. It has become clear that the effect of the improvement in the driving efficiency is small when only the aspect ratio is set close to 1. Accordingly, it is necessary to make further device in order to obtain more effect.

Before considering means for achieving such, a cause of the reduction in the efficiency due to the addition of the electrode pad has been studied. The states of flexure deformation are compared by observation between the case of the presence of an electrode pad with the case of the absence of an electrode pad in FIG. 4 and FIG. 5. As a result, it is understood that the deformation is lost at the connection portion between the electrode pad section and the driving section. From this, it is considered that the efficiency is lowered as the electrode pad section constrains free deformation of the driving section. Particularly, in the structure having the aspect ratio near 1, the cross-sectional area of the connection portion between the driving section and the electrode pad section is large. Therefore, it is considered that this large cross-sectional area constrains the deformation, and extremely lowers the efficiency.

From the result of the above research, it can be understood as follows. In order to improve the driving efficiency per unit area, it is important to use pressure chambers having a plane shape with the aspect ratio close to 1, and to realize a structure having small constraint on the electrode pad section.

In order to achieve the above objects, according to one aspect of the present invention, there is provided an inkjet recording head in which each actuator is comprised of: a driving section that is disposed in an area corresponding to a pressure chamber, and that is deformed in flexure together with a diaphragm when a driving signal is applied; an electrode pad section that is disposed in an area corresponding to a side wall of the pressure chamber, and that carries out an electrical connection with a driving signal source; and a bridge section that connects the driving section and the electrode pad section. In this inkjet recording head, the pressure chamber has a plane shape having an aspect ratio approximately equal to 1. In the bridge section, the width of a connection area to the driving section is smaller than the width of a connection side of the driving section. According to this aspect, it is possible to lower the constraint of the electrode pad section when the driving section deforms in flexure, and it is possible to prevent a reduction in the flexure deformation. Therefore, it is possible to realize the inkjet recording head having high driving efficiency.

In the above aspect of the invention, it is preferable that the width of the connection area to the driving section is reduced to a size equal to or less than one half of the width of the connection side of the driving section. Based on a very small connection area between the driving section and the electrode pad section, it is possible to substantially cancel the constraint of the electrode pad section when the driving section deforms in flexure, and prevent a reduction in the flexure deformation. Therefore, it is possible to realize the inkjet recording head having high driving efficiency.

Further, according to another aspect of the present invention, there is provided an inkjet recording head in which one or a plurality of bridge sections are connected to a driving section at a portion corresponding to the vicinity of a portion having small flexure deformation of a diaphragm. Further, one or a plurality of bridge sections are connected to a driving section at a position with a distance from the center of a connection area side of the driving section. Further, one or a plurality of bridge sections are connected to a driving section at a portion corresponding to the vicinity of the top of the pressure chamber. These portions are at the positions where basically the diaphragm is little deformed. Therefore, even when the electrode pad section is connected to the driving section by providing bridges in the vicinity, there is substantially no influence that the electrode pad section constrains the flexure deformation of the driving section. As a result, it is possible to obtain large deformation.

With this structure, the bending deformation of the bridge itself is small. Therefore, it is possible to prevent the occurrence of cracks in the bridge section and breaking due to fatigue.

It is possible to structure the edge portion of the area of the connection with the driving section of the bridge section in a curve. With this arrangement, it is possible to relax the stress concentration in the vicinity of the connection portion of the bridge section at the manufacturing time or at the time of driving flexure deformation. As a result, it is possible to prevent the destruction of the actuator. It is also possible to form the edge of the connection portion between the bridge section and the electrode pad section in a curve.

Further, according to still another aspect of the present invention, there is provided an inkjet recording head in which there is the following relationship: $Wp \leqq Wc-2\delta$, or $Wc+2\delta \leqq Wp$, where $\delta$ represents a positional deviation between a center position of a pressure chamber and a center position of a driving section, Wp represents a width of a plane shape of the driving section, and Wc represents a width of a plane shape of the pressure chamber. A Wc value corresponds to a value of A for each plane shape as shown in FIG. 3, for example. In general, the flexure deformation of the driving section is largely subjected to the influence of supporting conditions of the external periphery of the driving section. For example, it is possible to obtain large flexure deformation based on a rotation-free support, in a structure where the actuator is not applied to the external wall of the pressure chamber (the actuator is smaller than the pressure chamber). On the other hand, flexure deformation is small based on a fixed support, in a structure where the actuator is applied to the external wall of the pressure chamber (the actuator is larger than the pressure chamber). Assume that there exist the following two states. One state is that the driving section is applied to the external wall of the pressure chamber. The other state is that the driving section is not applied to the external wall of the pressure chamber, due to the positional deviation of the piezoelectric actuator under the disturbance in the manufacturing process. In this case, there is a large difference in flexure deformation between the two cases. In other words, the variation becomes large. According to this aspect of the invention, when $Wp \leqq Wc-2\delta$ is satisfied, the driving section is not applied to the external wall of the pressure chamber any time even when there has been a positional deviation in either direction. Therefore, it is always possible to keep the rotation-free supporting condition. In the mean time, when $Wc+2\delta \leqq Wp$ is satisfied, the external periphery of the driving section is always kept applied to the external wall of the pressure chamber even when a positional deviation has occurred. Therefore, it is always possible to keep the fixing supporting condition. As a result, when any one of these conditions is satisfied, the variation in the flexure deformation attributable to the positional deviation becomes small, and it is possible provide a high-precision inkjet recording head.

In the above aspect of the invention, it is more preferable that Wp is in the following range: $(Wc-2\delta)\times 0.9 \leqq Wp \leqq Wc-2\delta$. In general, under the same rotation-free supporting condition, the flexure deformation becomes small when Wc is smaller than Wp, as the flexure deformation area is small, and the flexure deformation becomes small when Wp is closer to Wc, as the supporting condition becomes close to the fixed support. In other words, Wp has an optimum value relative to Wc. According to this aspect of the present invention, as Wp can be set to an optimum value, it is possible to maximize the flexure deformation. At the same time, it is possible to minimize the variation in the flexure deformation relative to the positional deviation of the piezoelectric actuator. As a result, it is possible provide a high-precision inkjet recording head.

Further, according to still another aspect of the present invention, there is provided an inkjet recording head in which a plurality of nozzles are disposed two dimensionally. Further, a plurality of nozzles arrayed in one row with a constant interval between the nozzles, are disposed in a plurality of rows. Based on only a one-dimensional layout of nozzles, it is not possible to make the nozzle layout pitch smaller than the width of the pressure chamber. Therefore, it is not possible to realize a high-resolution inkjet recording head. However, according to this aspect of the present invention, it is possible to make the nozzle layout pitch smaller than the width of the pressure chamber. Therefore, it is possible to realize a high-resolution inkjet recording head.

According to the two-dimensional layout, the nozzles disposed at constant intervals in a row are arranged in N rows in a direction approximately orthogonal to the scanning direction of the inkjet recording head, for example. The layout of the nozzles in each row is sequentially differentiated by a constant distance of 1/N in a column direction. Alternatively, the nozzles in each row may be arrayed in equal distances so that the nozzles are disposed at crossing positions of lattices of parallelograms. According to the layout of this aspect of the invention, the nozzles are projected in a direction orthogonal to the scanning direction of the recording head (refer to FIG. 14). Based on this layout, as compared with the case where the nozzles are disposed one dimensionally, it is possible to narrow the pitches of the nozzles (the nozzle layout pitches) to 1/N of these pitches. In other words, it is possible to provide a high-resolution inkjet recording head.

Further, according to still another aspect of the present invention, there is provided an inkjet recording head of the above aspect in which a wiring substrate including a signal line is disposed to cover actuators that are disposed two dimensionally in a matrix. Further, the electrode pad section and the wiring substrate are electrically connected to each other via a bump. According to this aspect of the invention, a signal line to each piezoelectric actuator exists at the outside of the plane of each piezoelectric actuator. Therefore, it is possible to lay out the signal lines in high density without the need for each signal line space that has conventionally been provided between the actuators.

Further, according to still another aspect of the present invention, there is provided an inkjet recording head in which a bump is constructed of a conductive core material and a connection material with which the periphery of the core material is coated. According to this aspect of the invention, a clearance is formed between the wiring substrate and the piezoelectric actuator driving section. Therefore, the wiring substrate does not give influence to the flexure distortion of the driving section. Further, according to this aspect of the invention, the heated driving section due to the driving of the piezoelectric actuator is cooled with the air that flows through the clearance.

Further, according to still another aspect of the present invention, there is provided an inkjet recording head of the above aspect in which the core material is formed in a semi-spherical shape. According to this aspect of the invention, it is possible to ensure electrical and mechanical contact with the electrode pad section. Further, according to this aspect of the invention, it is possible to prevent a destruction of the electrode pad section in the process of forming a contact with the electrode pad section.

Further, according to still another aspect of the present invention, there is provided an inkjet recording head of the above aspect in which a wiring substrate is constructed to include at least a resin base material. According to this aspect of the invention, it is possible to prevent a destruction of the bump, even when the inkjet recording head has been expanded or warped due to a temperature change, as the wiring substrate of the resin base material has low rigidity.

Further, according to still another aspect of the present invention, there is provided an inkjet recording head of the above aspect in which the actuator is a piezoelectric actuator having a driving section made of a piezoelectric element. For manufacturing the piezoelectric actuator, a sandblasting method (to be described later) is applied. Based on this method, it is possible to process the piezoelectric actuator easily and precisely in a short time, even if the piezoelectric actuator has a complex shape having a plurality of bridge sections. As a result, it is possible to realize high-density ink jetting at low cost.

Further, according to still another aspect of the present invention, there is provided an inkjet recording head in which a dummy pattern is disposed to cover the external periphery of a piezoelectric actuator area where a plurality of piezoelectric actuators are laid out, and/or is disposed between the piezoelectric actuators. In general, the sandblasting method has a problem of size precision in the processing called sand etching. There is a film mask portion that is left in an area (each actuator, in the present invention) where grinding with sandblasting is not carried out. Blast grinding particles exist below the mask in the vicinity of the edge of this film mask portion, and these grinding particles are also ground. As a result, there occurs a variation in the finish processing size. This sand etching depends on presence or absence of an adjacent item to be processed. More specifically, the sand etching depends on a distance between the adjacent items to be processed. According to this aspect of the present invention, a dummy pattern exists on the external periphery of the piezoelectric actuator area. Therefore, there is little difference in the sand etching between the external periphery and the inside of the piezoelectric actuator area. Consequently, it is possible to obtain a uniform size, and it becomes possible to realize high precision. Further, according to this aspect of the invention, a dummy pattern also exits on the surrounding of each piezoelectric actuator. Therefore, there is little difference in the sand etching among all the piezoelectric actuators. As a result, it becomes possible to realize high precision.

Further, according to still another aspect of the present invention, there is provided an inkjet recording head in which a width of a groove that separates between a piezoelectric actuator and an adjacent dummy pattern (an isolation distance) is set substantially the same for all the grooves. According to this aspect of the invention, the sand etching becomes the same for all the piezoelectric actuators. Therefore, it is possible to obtain a uniform size. As a result, it becomes possible to realize high precision.

Further, according to still another aspect of the present invention, there is provided an inkjet recording apparatus that is mounted with any one of the inkjet recording heads according to the above aspects of the invention.

DETAILED DESCRIPTION OF THE PREFERRED EMBODIMENTS

Embodiments of the present invention will be explained in detail below with reference to the attached drawings.

First Embodiment

Structure

Figure 1:
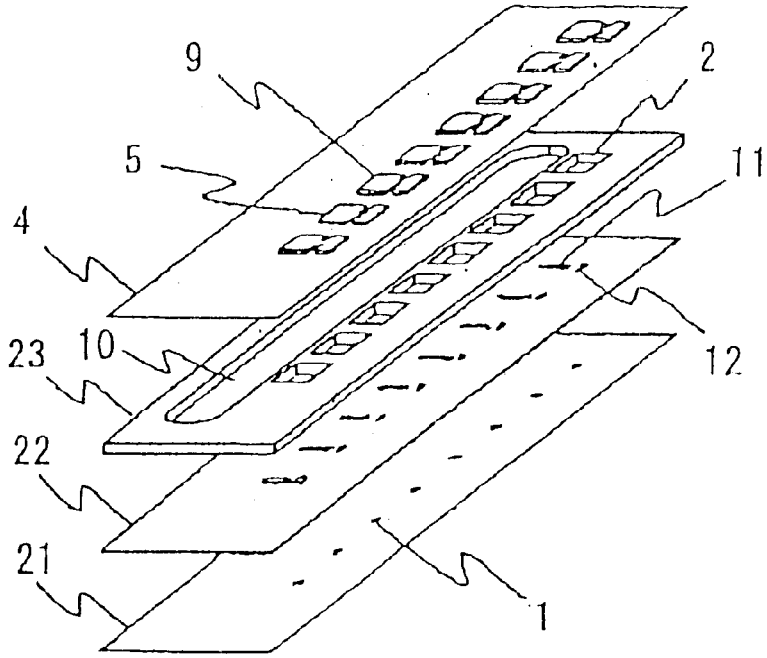
FIG. 1 is an exploded perspective view of an inkjet recording head according to a first embodiment of the present invention.
Figure 2A:
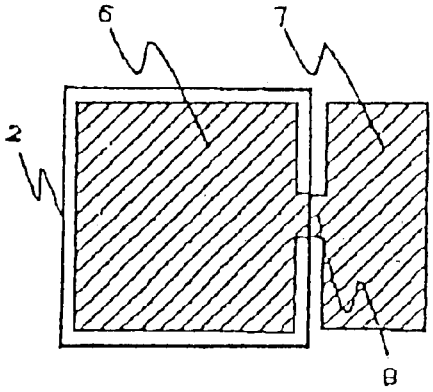
FIGS. 2A and 2B are top plan perspective diagrams of a piezoelectric actuator and a pressure chamber of the inkjet recording head according to the first embodiment of the present invention.
Figure 2B:
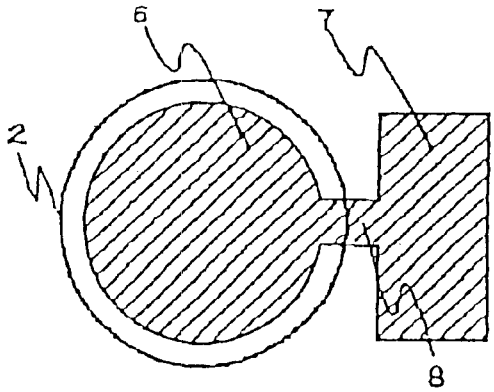
Figure 3A:
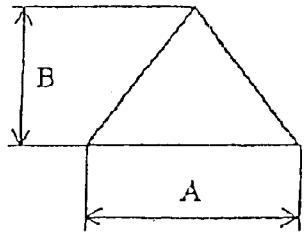
FIGS. 3A–3D shows diagrams for explaining a definition of the aspect ratio based on various kinds of plane shapes.
Figure 3B:
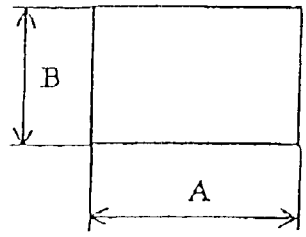
Figure 3C:
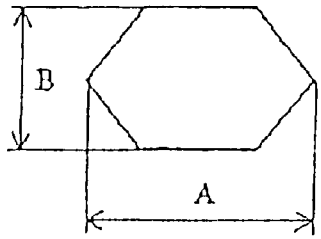
Figure 3D:
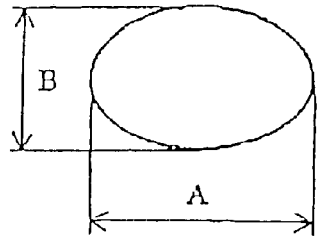
Figure 4:
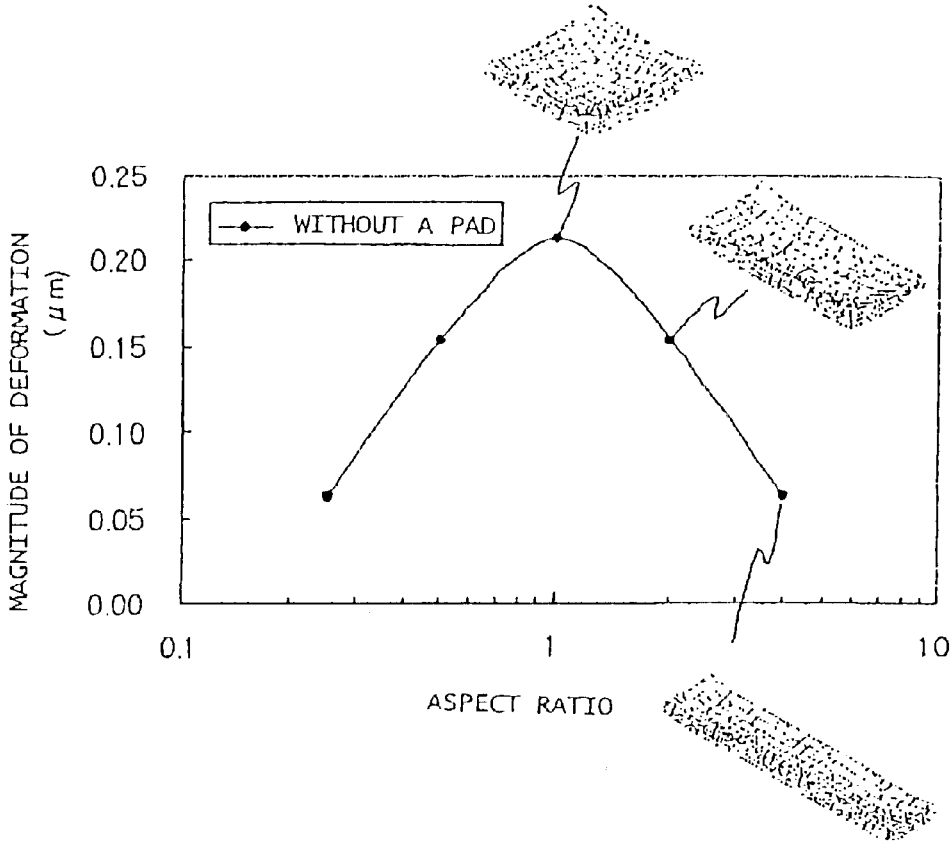
FIG. 4 is an explanatory diagram of a result of an analysis of flexure deformation when there is no electrode pad in each piezoelectric actuator, in a head structure having different aspect ratios in the same area.
Figure 5:
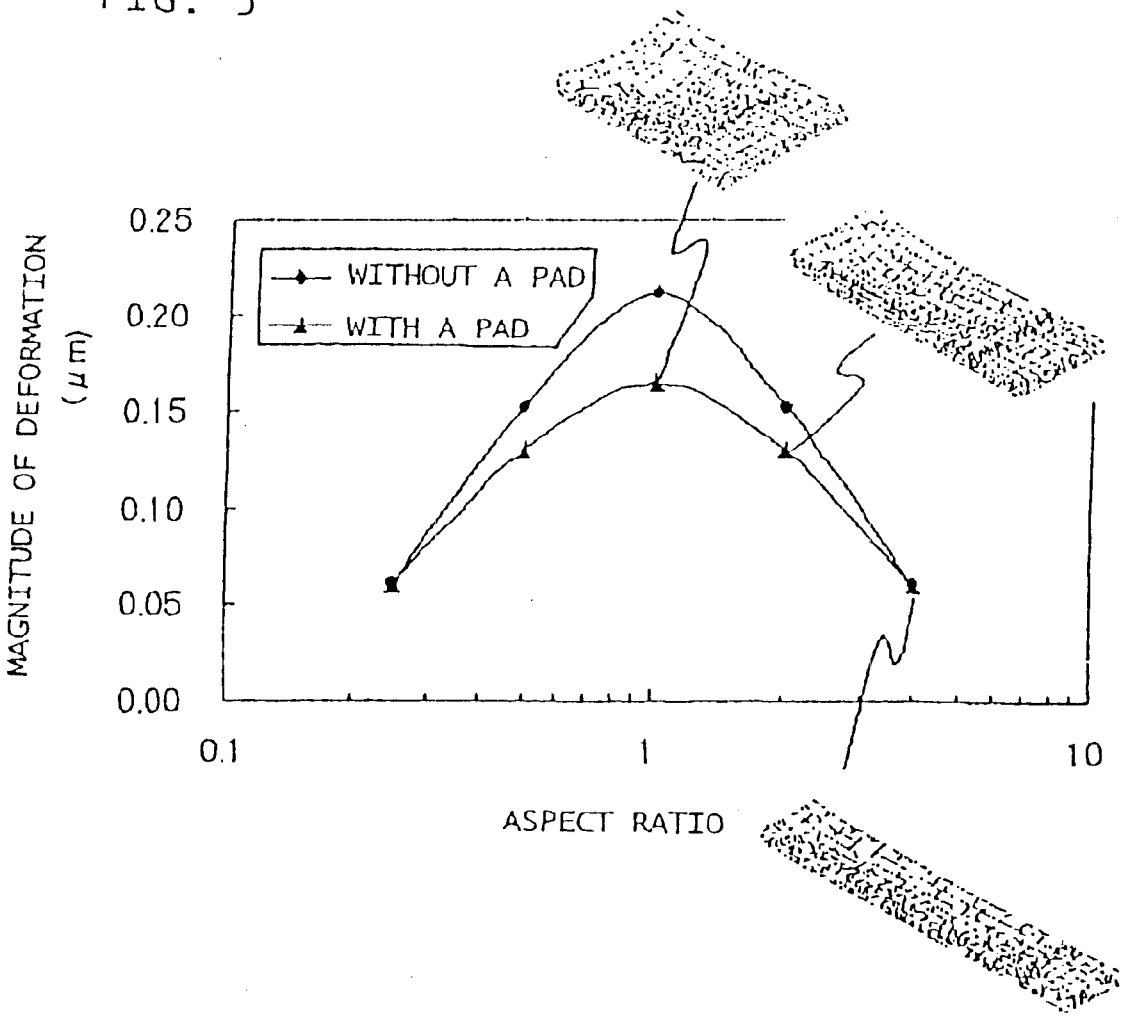
FIG. 5 is an explanatory diagram of a result of an analysis of flexure deformation when there is an electrode pad in each piezoelectric actuator, in addition to the diagram shown in FIG. 4.
Figure 19:
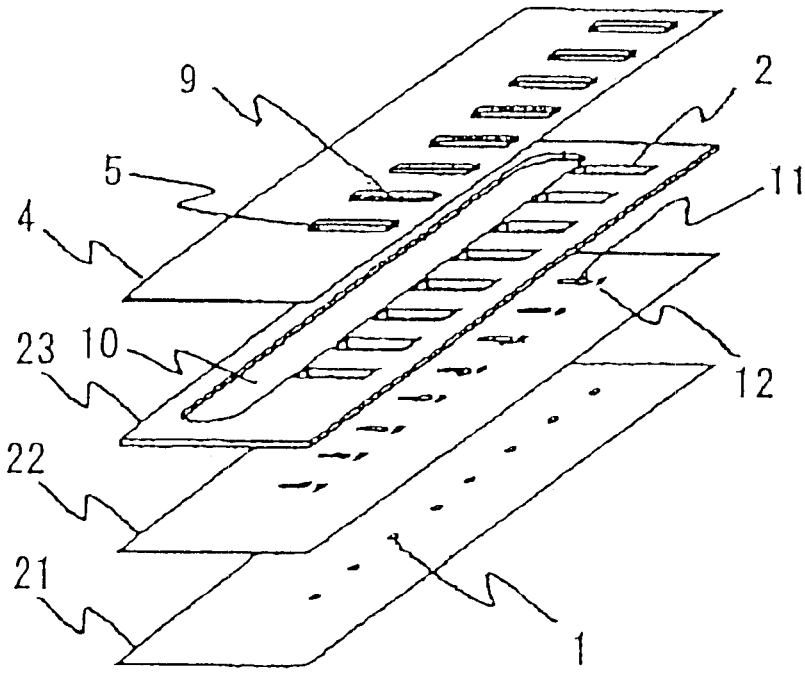
FIG. 19 is an exploded perspective diagram of a conventional inkjet recording head.
Figure 20:
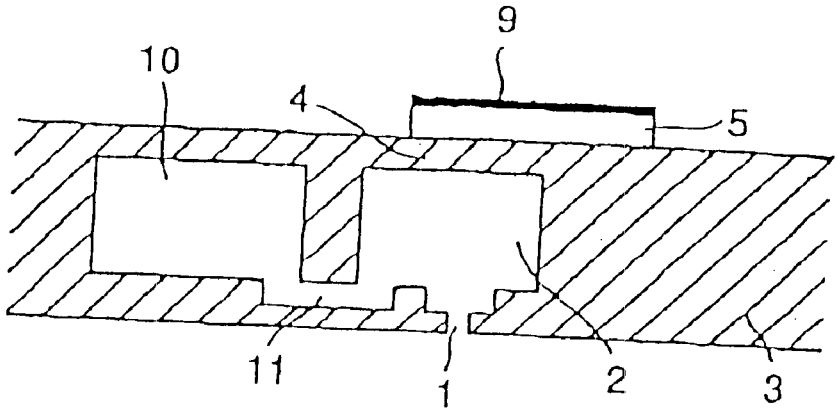
FIG. 20 is a cross-sectional diagram of a vicinity of a pressure chamber in the conventional inkjet recording head.

FIG. 1 shows a structure on an inkjet recording head according to a first embodiment of the present invention. FIG. 2A is a top plan perspective diagram of one piezoelectric actuator shown in FIG. 1. FIG. 2B is a top plan perspective diagram of another piezoelectric actuator that can be used in a similar manner. The inkjet recording head according to the present embodiment has substantially a similar structure to that as shown in FIG. 19, except that a pressure chamber and a piezoelectric actuator have different shapes from those as shown in FIG. 19, respectively. This inkjet recording head is provided with a plurality of nozzles 1 which selectively jet ink droplets, pressure chambers 2 which are disposed corresponding to respective ones of the nozzles 1 and have a regular square plane shape (typically having an aspect ratio approximately equal to 1), an ink pool 10 that supplies ink to each pressure chamber 2, supply paths 11 that connect between respective ones of the pressure chambers and the ink pool 10, a diaphragm 4 that forms one surface of the pressure chambers 2, and piezoelectric actuators 5 that are coupled with the diaphragm 4.

Each piezoelectric actuator 5 is constructed of a driving section 6, an electrode pad section 7, and a bridge section 8 that connects the driving section 6 and the electrode pad section 7. The driving section 6, the electrode pad section 7, and the bridge section 8 are formed as a single piece, which will be described later. The driving section 6 is disposed in an area corresponding to the corresponding pressure chamber 2, and is deformed in flexure together with the diaphragm 4 when a driving voltage is applied. The electrode pad section 7 is disposed in an area corresponding to a side wall of the pressure chamber 2, to provide an electrical connection with a driving signal source. The bridge section 8 that connects the driving section 6 and the electrode pad section 7 has a connection section to the driving section, which is smaller in width than a connection side of the driving section. An individual electrode 9 for applying a driving voltage is disposed on the surface of the piezoelectric actuator 5. The diaphragm 4 also has a role of a common electrode.

Each member of the inkjet recording head according to the first embodiment will be described in detail below. Four kinds of plates used in the present embodiment, that is, nozzle plate 21, supply-path plate 22, pressure chamber plate 23, and diaphragm 4, are all made of stainless steel (SUS). The nozzle plate 21 is 75 $\mu$m in thickness, and is provided with the nozzles 1 having a 1.016-mm pitch, each of which is 30 $\mu$m in diameter, and. The supply-path plate 22 is 25 $\mu$m in thickness and is provided with a plurality of through-holes 12, each of which is 100 $\mu$m in diameter and is disposed at a position corresponding to a corresponding nozzle 1, and a plurality of supply paths 11 each connecting between a corresponding pressure chamber 2 and the ink pool 10. The pressure chamber plate 23 is 150 $\mu$m in thickness, and is provided with the ink pool 10 and the pressure chambers 2, each of which is shaped like a regular square with the center thereof positioned corresponding to a corresponding nozzle 1. The size of each pressure chamber 2 is determined based on the flexure deformation of the diaphragm 4 necessary for jetting a required amount of ink droplet. In the present embodiment, each pressure chamber 2 has a size of 500 $\mu$m×500 $\mu$m. The diaphragm 4 is 10 $\mu$m in thickness. The above plates 21–23 and 4 are each provided with alignment markers (not shown) for positioning.

A piezoelectric material of the piezoelectric actuator 5 may be made of lead-titanate-zirconate-based ceramics, or a material made of ordinary ferroelectdrics. As a material for the individual electrode 9, gold, silver, palladium, or other metal having conductivity is used. The driving section of the piezoelectric actuator 5 is shaped like a regular square which has a size of 460 $\mu$m×460 $\mu$m with the same center as that of the area of a corresponding pressure chamber. Therefore, there exists a clearance of 20 $\mu$m between the external periphery of the driving section 6 and the external periphery of the area corresponding to the pressure chamber. The electrode pad section of the piezoelectric actuator 5 has a size that is determined as an area required for electrical connection when driven. The bridge section 8 connecting the driving section 6 and the electrode pad section 7 is provided at the center of a side on which the driving section and the electrode pad section face each other. The bridge section 8 is 40 $\mu$m in length and 100 $\mu$m in width.

Operation

An operation of the present embodiment will be described hereafter. First, ink is charged into an ink supplying unit (not shown) connected to the ink pool 10. The ink is charged into each pressure chamber 2 through the route of the ink supplying unit, the ink pool, and the pressure chamber. Then, a driving voltage is applied to between the individual electrode 9 of a selected piezoelectric actuator 5 and the common electrode (the diaphragm 4). This causes the piezoelectric actuator 5 and the diaphragm 4 to be deformed in flexure in the area of the corresponding pressure chamber 2, thereby to compress the ink within the pressure chamber (that is, the internal pressure of the pressure chamber is increased). As a result, droplets of ink are jetted from a corresponding nozzle 1.

In the present embodiment, the pressure chamber has a regular plane shape having an aspect ratio approximately equal to 1. Therefore, the pressure chamber has a structure that is advantageous in the aspect of driving efficiency as compared with the conventional pressure chamber that has a rectangular shape.

Further, each piezoelectric actuator disposed in the pressure chamber is constructed of a driving section, an electrode pad section, and a bridge section that connects the driving section and the electrode pad section. The width of the bridge section at the connection portion to the driving section is set smaller than the width of the driving section. The constraint of the electrode pad section is large when only the aspect ratio is set approximately equal to 1, and, in this case, it is not possible to sufficiently exhibit the target effect of the improvement in the driving efficiency, as explained above. However, the provision of the bridge section according to the present embodiment can reduce the constraint of the electrode pad section when the driving section is deformed in flexure. As a result, the improvement in the driving efficiency to be targeted by setting the aspect ratio to approximately 1 can be achieved.

Figure 7:
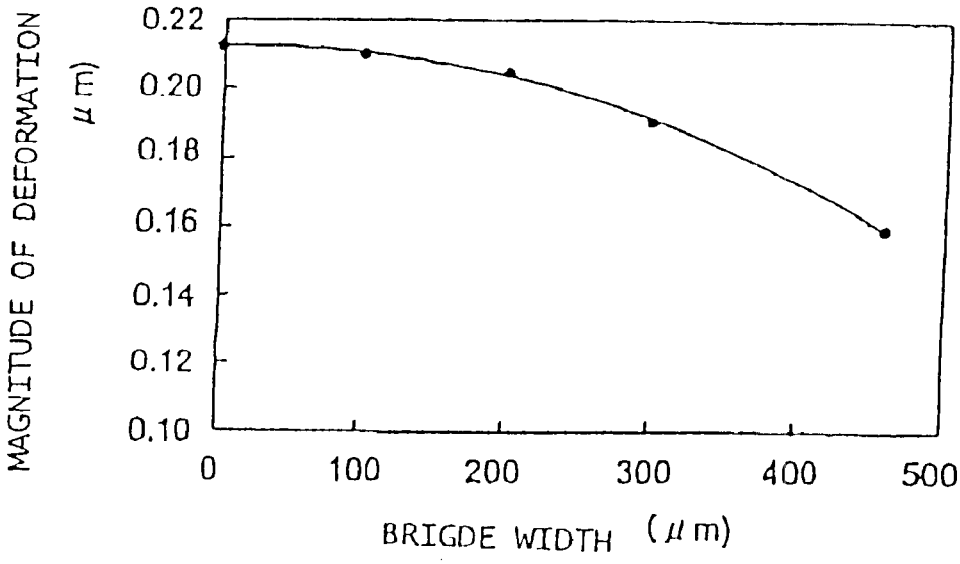
FIG. 7 is a graph showing flexure deformation of a structure according to the first embodiment of the present invention, and structures of a plurality of inkjet recording heads having different widths of bridge sections.
Figure 21:
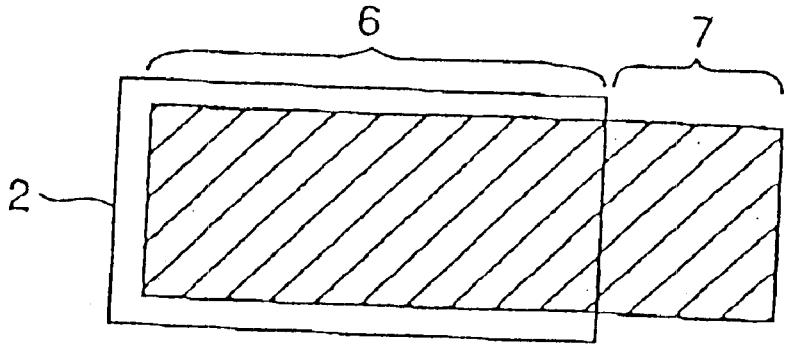
FIG. 21 is a top plan perspective diagram of a piezoelectric actuator and a pressure chamber in the conventional inkjet recording head.

In order to check this effect, a plurality of inkjet recording heads having different widths of bridge sections have been prepared based on the structure of the embodiment of the present invention to compare the flexure deformation between samples. FIG. 7 shows a result of such comparison. The horizontal axis shows a width of the bridge section, and the vertical axis shows flexure deformation. In the horizontal axis, 0 μm means a head structure having no bridge. The electrode pad is electrically connected to the driving section by wire bonding. Further, in the horizontal axis 460 μm means a conventional head structure in which the driving section and the electrode pad section are connected like a strip without neck (see FIG. 21). From the result of the comparison, it has been confirmed as follows. First, the bridge section causes the constraint of the electrode pad section to be relaxed, as compared with the constraint in the conventional structure, and it is possible to make the flexure deformation larger. Second, it is possibly to make the flexure deformation larger as the bridge width is set smaller. Particularly, it has been confirmed that, when the width of the bridge section can be set to not larger than a half of the width of the driving section, it is possible to cancel substantially the whole constraint of the bridge, resulting in effectively preventing a reduction in the flexure deformation.

Japanese Patent Application Laid-open Publication No. 11-78015 discloses an inkjet recording head that uses piezoelectric actuators each having a driving section, an electrode pad section, and a bridge section. In this publication, however, each pressure chamber is shaped like a slender rectangular. Further, this publication has no description regarding a relationship between the plane shape of a pressure chamber (an aspect ratio) and the driving efficiency. According to this publication, each electrode pad section is disposed on the short side of a corresponding pressure chamber. Therefore, the influence of the electrode pad section constraining the driving section is almost negligibly small. In contrast, according to the present invention, as the main subject of the present invention, focus has been placed on the effect of the improvement in the driving efficiency that is achieved by setting the aspect ratio of a plane shape of the pressure chamber to approximately 1 and reducing the constraint of the electrode pad section. Accordingly, the present invention is different from the above publication in these aspects.

Further according to the present embodiment, the sandblasting method is used for processing the piezoelectric actuators. This makes it possible to manufacture an actuator having a complex shape. A manufacturing method (the sandblasting method and the head assembling method) of the present embodiment will be described hereafter.

Manufacturing process

Figure 6:
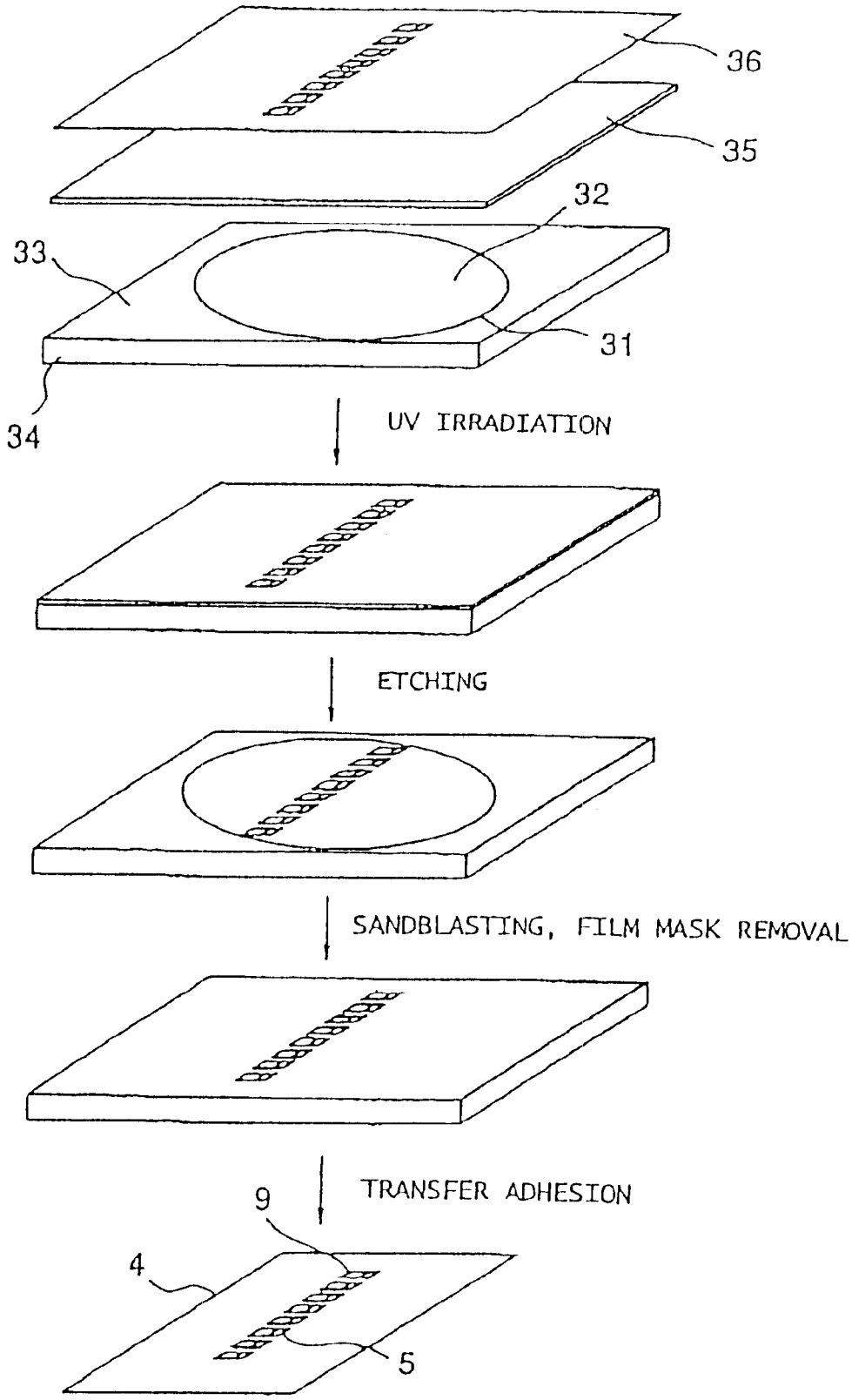
FIG. 6 is a diagram for explaining a method of manufacturing a piezoelectric actuator according to the first embodiment of the present invention.

As shown in FIG. 6, first, a piezoelectric material block (not shown) is lapped to prepare a piezoelectric material plate 31. A thickness of the piezoelectric material plate 31 is determined based on a magnitude of flexure deformation necessary for a piezoelectric actuator 5 and a driving voltage. In the present embodiment, the piezoelectric material plate 31 has a thickness of 30 μm. An electrode film 32 is sputtered on both sides of this piezoelectric material plate 31. In the present embodiment, gold is used as the electrode material. Next, the sputtered piezoelectric material plate 31 is provisionally fixed to a fixing plate 34 by an adhesive foamed tape 33 that has no adhesive force at high temperatures. This fixing plate has in advance an alignment marker (not shown) attached therewith for positioning a junction with a SUS flow-path plate.

A photosensitive film mask 35 is adhered onto this piezoelectric material plate 31 that is provisionally fixed to the fixing plate 34. In the present embodiment, a urethane film mask having a thickness of 50 μm is used. Then, there is separately prepared an exposure mask 36 that has a pattern for transmitting ultraviolet rays (UV) through only a portion to be left as a piezoelectric actuator. This exposure mask 36 is adhered onto the film mask. This exposure mask 36 is patterned with reference to the alignment marker of the fixing plate. UV rays are irradiated onto the piezoelectric material plate 31 that has been covered with the film mask 35, via the exposure mask 36. Then, this piezoelectric material plate 31 is etched. For the etching liquid, there is used a liquid that dues not remove the portion irradiated with the UV rays but can securely remove other portions. In the present embodiment sodium carbonate is used.

By performing the above process, the film mask 35 is left at only the portion that is to be left as the piezoelectric actuator 5, and the film mask 35 at all other portions is removed. Then, the sandblasting is carried out on this structure. The sandblasting is performed under the condition that the exposed portions of the piezoelectric material after the film mask 35 has been removed are securely ground and removed and the piezoelectric material at the portion where the film mask 35 remains is not ground. After the sandblasting the film mask 35 that remains on the surface of the piezoelectric material is removed and cleaned. In the above process, there is formed a structure that the piezoelectric actuators 5 having the electrode film 32 on both sides thereof are adhered onto the fixing plate 39 with the adhesive foamed tape 33.

Subsequently, the piezoelectric material is adhered onto the diaphragm 4. First, an adhesive (not shown) is coated onto the piezoelectric material. In the present embodiment, since the diaphragm 4 is also used as a common electrode, a conductive adhesive is coated. After such an adhesive has been coated, the piezoelectric actuators 5 are overlaid on the diaphragm 4 with reference to the alignment marker of the fixing plate 34 and the diaphragm 4. The adhesive is cured at 200° C. applying pressure of 2 kg per one square centimeter, thereby to couple the piezoelectric actuators 5 with the diaphragm 4 . When heated, the adhesive foamed tape 33 that has been used to provisionally fix the piezoelectric actuators 5 on the fixing plate 34 loses the adhesive force, and this tape can be peeled off easily. In the above process, a unit is obtained that has the piezoelectric actuators 5 adhered onto the diaphragm 4 (patterning which is also used as a cotton electrode, and has the individual electrodes 9 disposed on the free surface sides of the respective actuators 5. It is possible to obtain an ink jet recording head by adhering this trait onto a SUS flow-path unit that has been formed by separately connecting the nozzle plate, the supply path plate, and the pressure chamber latter together other than the diaphragm 4.

Finally, an electrical connection is carried out for applying a driving voltage to each piezoelectric actuator 5. In the present embodiment, an FFC cable (not shown) is adhered onto the periphery of the inkjet recording head. Then, the electrode terminal and the individual electrode of each piezoelectric actuator are connected together by wire bonding. In this case, a portion for dropping wire onto the individual electrode is the electrode pad section of the piezoelectric actuator. By the above manufacturing process an inkjet recording head according to the present embodiment is completed.

According to the sandblasting method used in the present embodiment, it becomes possible to process a piezoelectric actuator having a complex plane shape. Further, it is possible to precisely process the piezoelectric actuators in a simple method and in a short time. Therefore, it is possible to lower the cost.

In the above first embodiment, a regular square shape is used for each pressure chamber. However, the plane shape of each pressure chamber in the present invention is not limited to the regular square. It is also possible to use a polygon or a circle for the plane shape of each pressure chamber, so long as the pressure chamber has a plane shape that has an aspect ratio approximately equal to 1. For example, when the pressure chamber has a circular shape for the plane as shown in FIG. 2B, it is also possible to obtain exactly similar work and effects to those of the above case having a regular square shape. When the actuator has a pressure chamber having approximately a circular shape for the plane and a driving section having approximately a circular shape, the diameter of the circular driving section is regarded as the size of the width of the connection area of the driving section.

Second Embodiment

Figure 10:
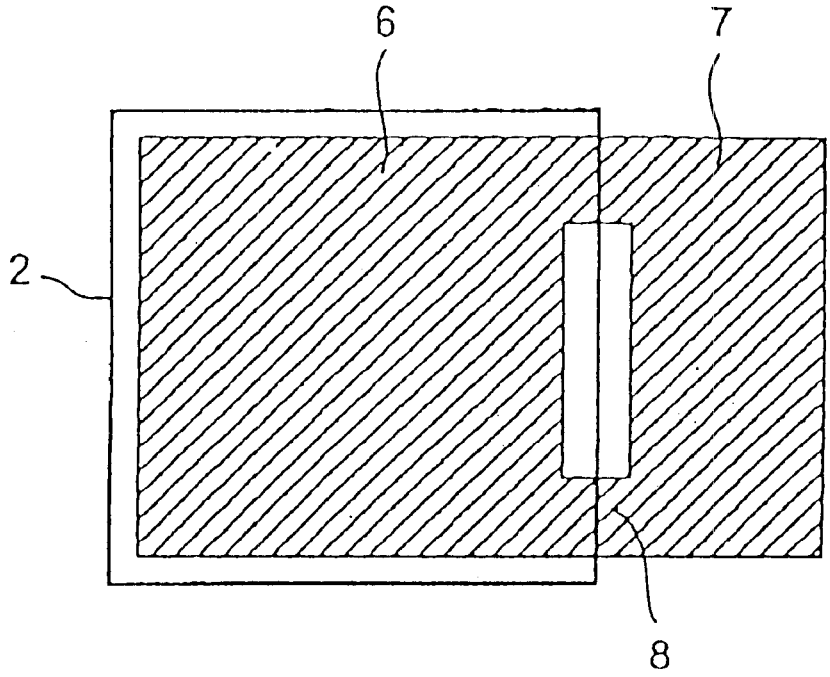
FIG. 10 is a top plan perspective diagram of a piezoelectric actuator and a pressure chamber of an inkjet recording head according to a second embodiment of the present invention.

FIG. 10 is a top plan perspective diagram showing a relative position of a piezoelectric actuator and a pressure chamber of an inkjet recording head according to a second embodiment of the present invention. The second embodiment is different from the first embodiment only in only two bridge sections are disposed corresponding to corner portions (vertexes) of a pressure chamber, for connecting a driving section and an electrode pad section of a piezoelectric actuator. This embodiment is similar to the first embodiment in that an area of connection between a driving section and an electrode pad section is small. The positions of the driving section and the electrode pad section relative to the pressure chamber is the same as those of the first embodiment.

In the present embodiment, it also possible to reduce the constraint of the electrode pad section when the driving section deforms in flexure, by setting the width of the bridge section in the connection to the driving section smaller than the width of the driving section. Therefore, it is possible to realize the improvement in the driving efficiency.

Figure 11A:
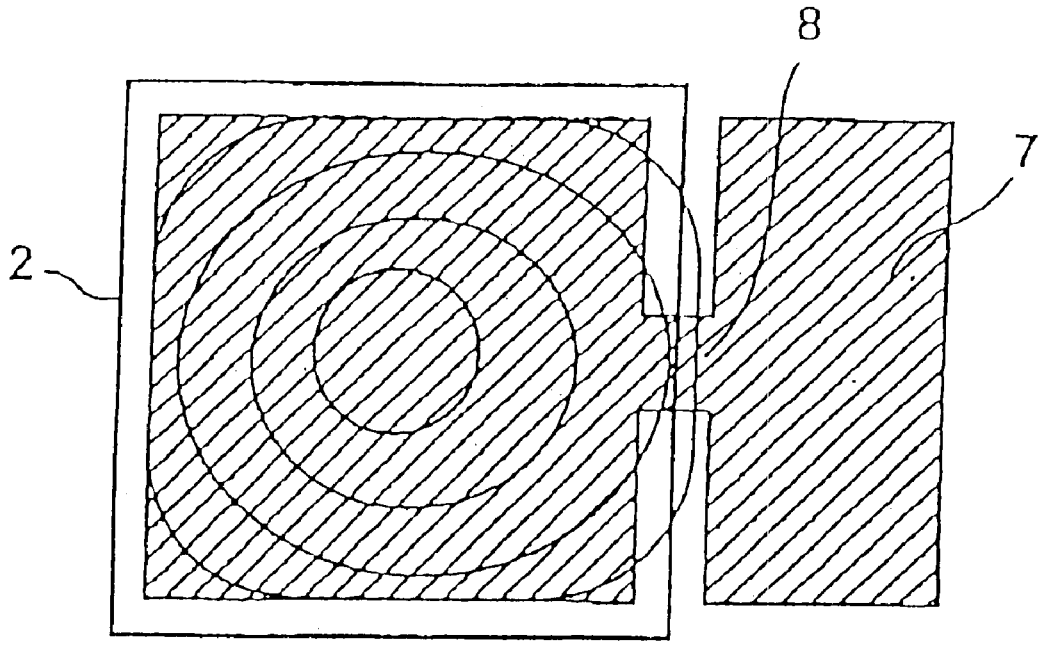
FIGS. 11A and 11B are explanatory diagrams showing flexure deformation contour lines of the driving section and the bridge section according to the first embodiment and the second embodiment of the present invention respectively.
Figure 11B:
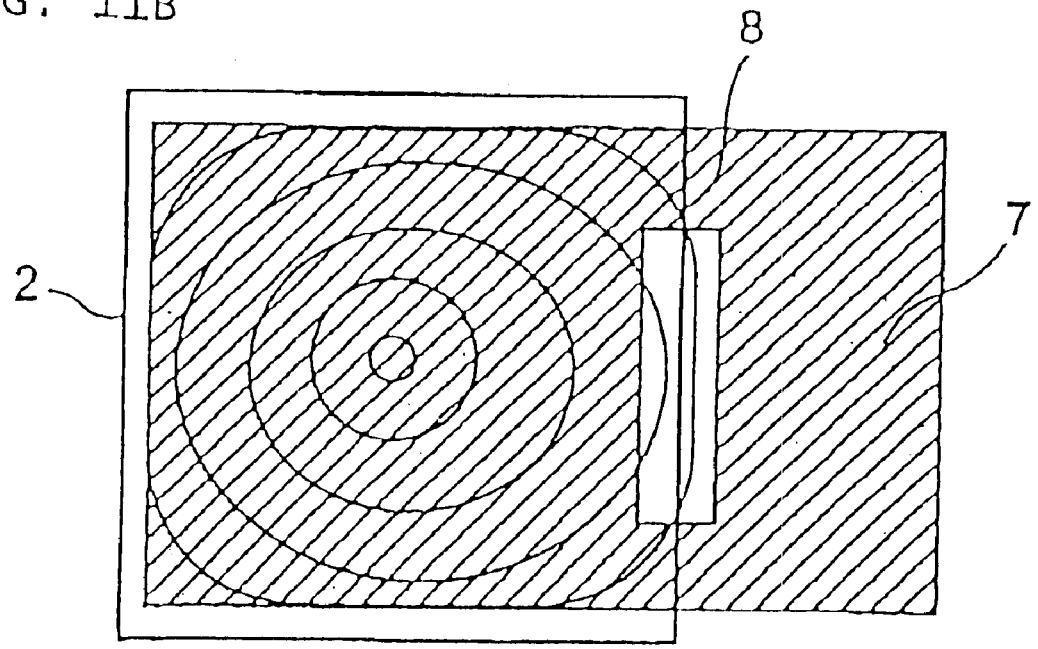

In order to verify the effect of the present embodiment, the flexure deformation of the driving section has been experimentally measured in the respective structures of the first and second embodiments. FIGS. 11A and 11B show flexure deformation contour line patterns in the driving section and the bridge section according to the first embodiment and the second embodiment of the present invention, respectively. As shown in these drawings, the structure of the second embodiment as shown in FIG. 11B has a larger number of contour lines in total. In other words, a larger flexure deformation is obtained in the structure of the present embodiment. Specifically, a maximum magnitude of flexure deformation in the first embodiment is 0.207 $\mu$m, and a maximum magnitude of flexure deformation in the second embodiment is 0.213 $\mu$m. It is understood from the above that, in the present embodiment, it is possible to further reduce the influence of constraining the flexure deformation of the driving section, compared with the first embodiment, resulting in larger flexure deformation.

A larger flexure deformation can be obtained in the present embodiment, because of a difference ire the level of constraint of the electrode pad section on the driving section. Referring to FIGS. 11A and 11B, displacement near the vicinity of the center of one side of the square (the bridge section in the first embodiment) is compared with displacement near both ends of one side of the square (the bridge section in the second embodiment). It is understood from this comparison that the latter case has the bridge section provided at a portion having smaller displacement. Therefore, it is considered that the influence of the constraint due to the addition of the electrode pad section is smaller in the second embodiment where the bridge sections are disposed at portions providing intrinsically small displacement, achieving the higher driving efficiency.

Further, it is understood from FIGS. 11A and 11B that the number of contour lines at the bridge section in the present embodiment is smaller than that in the first embodiment. This means that the bending deformation of the bridge itself is smaller. Therefore, it is possible to prevent the occurrence of cracks and fatigue destruction of the bridge section.

As described above, according to the present embodiment, it is possible to further improve the driving efficiency, and to improve the reliability of the bridge section.

Figure 8:
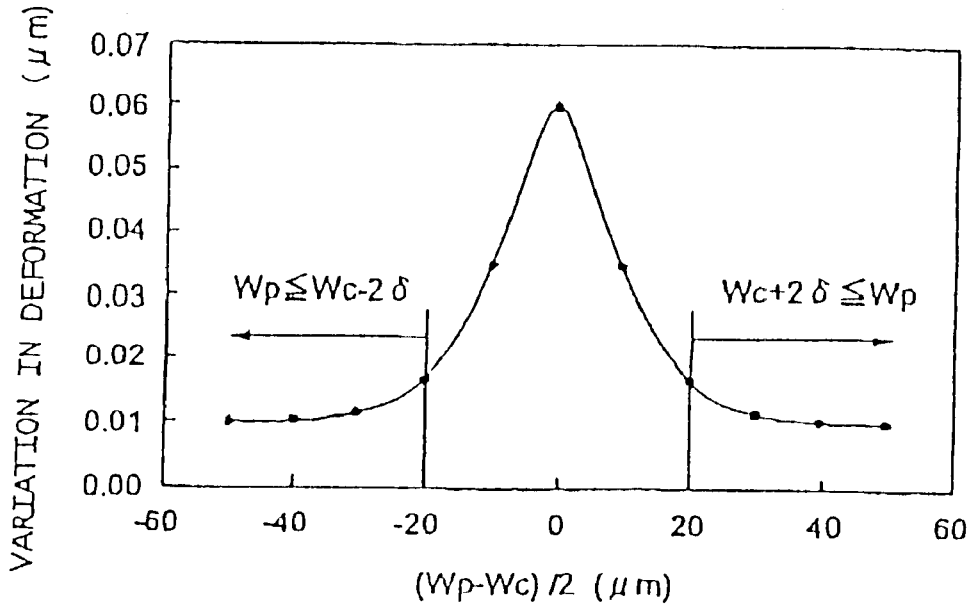
FIG. 8 is a graph showing a variation in the flexure deformation relative to a value of (Wp−Wc)/2 at the time of driving a driving section when the width Wp in the plane shape of the driving section is changed while keeping constant the width of the plane shape of a pressure chamber.

Further, as a complementary research into the present embodiment, the relationship between Wc and Wp has been studied to detail. FIG. 8 shows a variation in the flexure deformation relative to a value of $(Wp-We)/2$ in the horizontal axis by changing the width Wp while keeping constant the width Wc of the plane shape of a pressure chamber, when the position of the piezoelectric actuator is deviated by $\delta$. A value in the horizontal axis means a clearance between the driving section and the external wall, of the pressure chamber. When this value is positive, it means that the driving section sticks out from the external periphery of the pressure chamber. When this value is negative, the driving section is accommodated within the external periphery of the pressure chamber. The positional deviation $\delta$ is set to 20 $\mu$m that is assumed in the actual manufacturing process. As a result, it has become clear that it is possible to minimize the variation by setting Wp in the region of $(Wp-Wc)/2 \leqq -\delta$, or $\delta \leqq (Wp-Wc)/2\Delta$, that is, $Wp \leqq Wc-2\delta$, or $Wc+2\delta \leqq Wp$. This expression means that it is possible to keep constant the supporting condition of the periphery of the driving section even when a positional deviation has occurred. In other words, in the former case, the supporting condition is always the rotation-free support even when a positional deviation has occurred. On the other hand, the supporting condition is always the fixed support, in the latter case. The flexure deformation is influenced large by the supporting condition, as described above. However, when this condition is satisfied, there occurs no change in the supporting condition due to the positional deviation, and thus, it is possible to suppress the variation.

Figure 9:
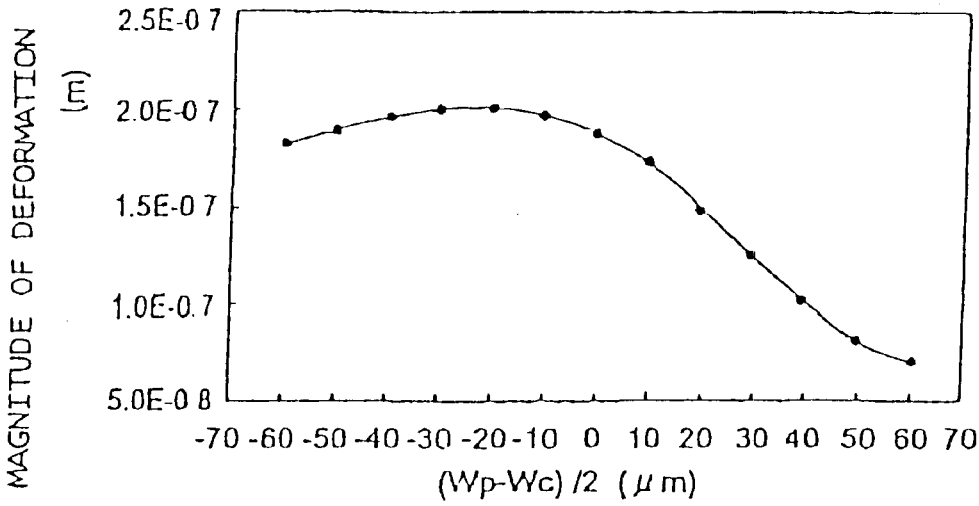
FIG. 9 is a graph showing flexure deformation relative to a value of (Wp−Wc)/2 at the time of driving a driving section when the width Wp in the plane shape of the driving section is changed while keeping the width of the plane shape of a pressure chamber constant.

FIG. 9 shows flexure deformation when Wp is changed while keeping Wc constant in the case of no positional deviation. It is understood from this that Wp preferably falls into the region of $(Wc-2\delta)\times 0.9 \leqq Wp \leqq Wc-2\delta$ to maximize the flexure deformation. This expression means that there is an optimum range for Wp, because, when the driving section is smaller than the external periphery of the pressure chamber, this provides a rotation-free supporting condition that: is advantageous for the flexure deformation, however, when the driving section is too small, the driving area becomes smaller, resulting in reduced flexure deformation. The positional deviation $\delta$ is about 10 $\mu$m to 30 $\mu$m when a general alignment method is used. In this case, it is optimum when the width Wp of the driving section is set smaller than the width Wc of the pressure chamber by about 20 $\mu$m to 60 $\mu$m.

The present embodiment has a structure that satisfies this requirement. Therefore, it is possible to provide a high-precision inkjet recording tread having a small variation in the flexure deformation relative to the positional deviation of the piezoelectric actuator. It is also possible to maximize the flexure deformation itself.

Other structures

In addition to the structure shown in the present embodiment, it is also possible to employ a structure or a combination of structures as shown in FIGS. 12A to 12D. In FIGS. 12A to 12D, a bridge section 8 is connected to a driving section 6 at a position near a portion of small flexure deformation of the diaphragm, or at a position with a distance from the center of the side of the connection area of the driving section.

Figure 12A:
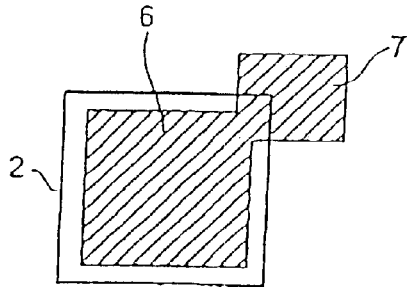
FIGS. 12A, 12B, 12C, and 12D are diagrams showing shapes of the piezoelectric actuator according to the second embodiment of the present invention respectively.
Figure 12B:
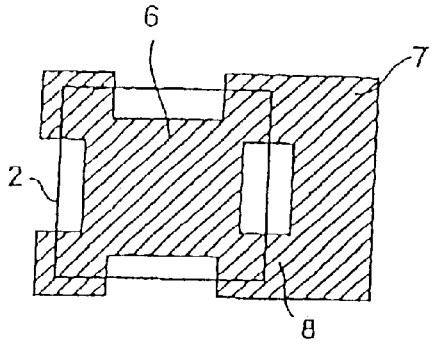
Figure 12C:
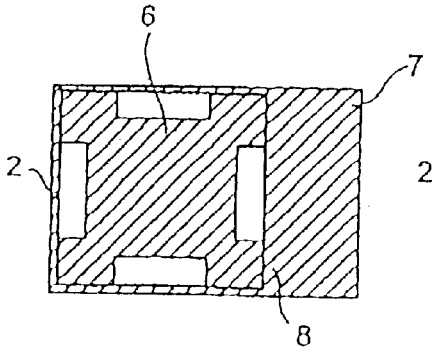
Figure 12D:
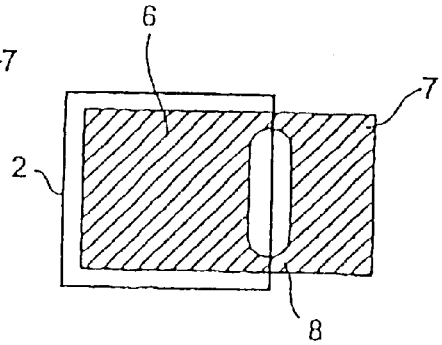

FIG. 12A shows a case where one bridge section is provided at one vertex of the regular square of a pressure chamber 2. FIG. 12B shows a case where a bridge section is provided at four corners of a similar pressure chamber 2, instead of the center of each side of the connection area of the pressure chamber 2. FIG. 12C shows a case where a driving section 6 exists substantially within only a region of a pressure chamber 2 and bridge sections are formed at two corners, by culling away a portion corresponding to the center of each side of, the connection area of the pressure chamber 2. FIG. 12D shows a case where the inner edge portions of a bridge section 8 at a connection area with a driving section 6 and a connection area with an electrode pad section 7 are formed in curves. These structures causes the constraint of the electrode pad section on the driving section to be smaller, and it becomes possible to further improve the driving efficiency. Further, even when a positional deviation has occurred between the piezoelectric actuator and the pressure chamber, it is possible to reduce the area of a flexure portion of the diaphragm (an exposed portion of the diaphragm having no piezoelectric actuator out of the area corresponding to the pressure chamber). Therefore, it is possible to avoid such a phenomenon that this portion is deformed in escape due to the internal pressure of the ink at the driving time and thereby the driving efficiency is lost. Further, based on the structure as shown in FIG. 12D, a stress concentration in the vicinity of the connection portion can by relaxed as compared with the case of the second embodiment as shown in FIG. 10. Accordingly, it is possible to prevent a destruction of the piezoelectric actuator.

Third Embodiment

Figure 13:
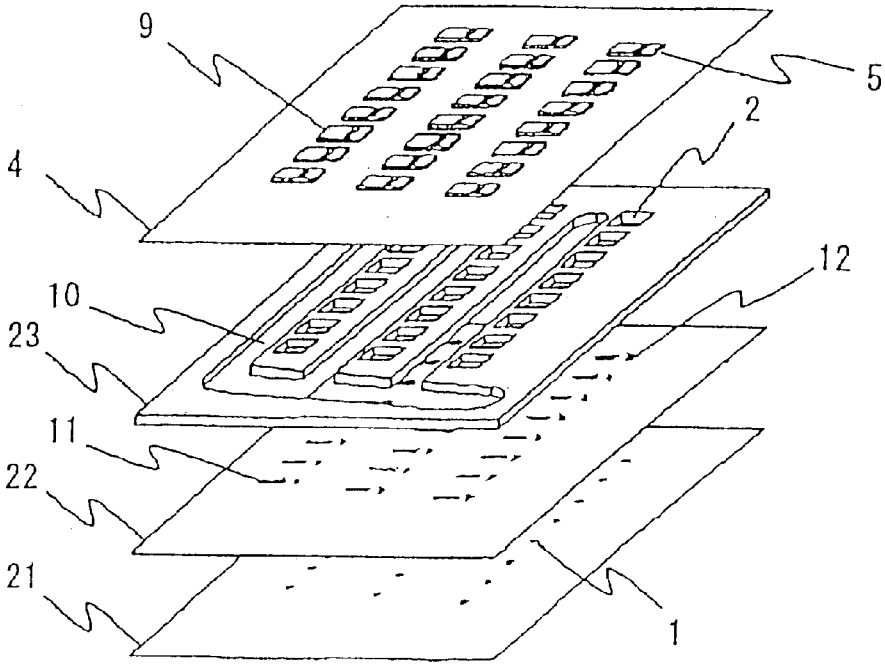
FIG. 13 is an exploded perspective diagram of an inkjet recording head according to a third embodiment of the present invention.
Figure 14:
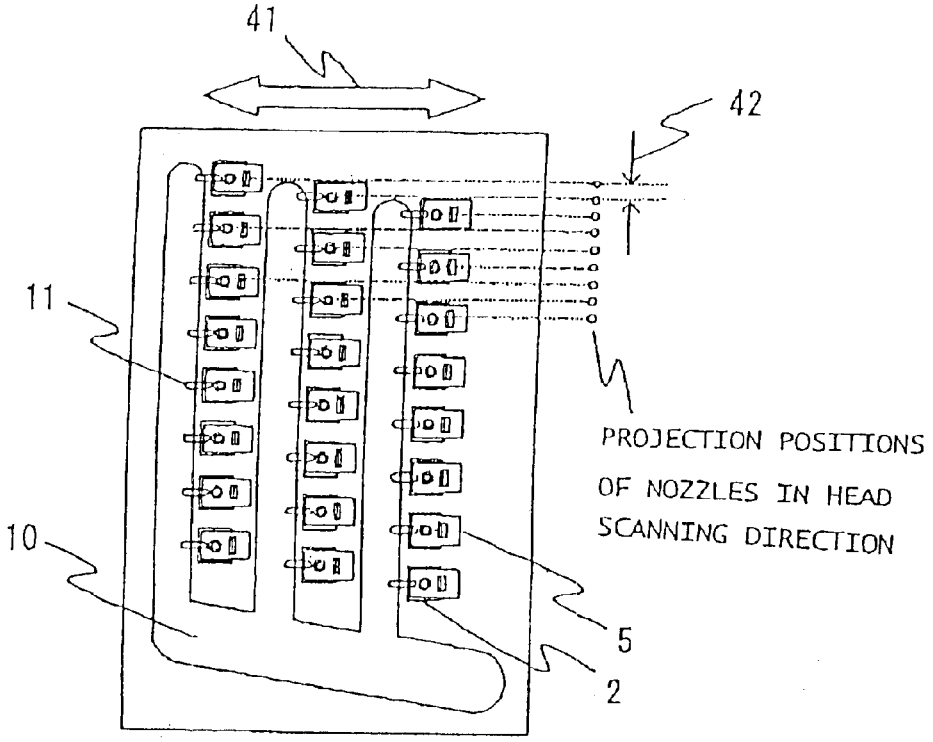
FIG. 14 is a top plan perspective diagram of the inkjet recording head according to the third embodiment of the present invention.

FIG. 13 is an exploded perspective diagram of an inkjet recording head according to a third embodiment of the present invention. FIG. 14 is a top plan perspective diagram of this inkjet recording head. As shown in these drawings according to the third embodiment, a plurality of pressure chambers and corresponding nozzles (nozzle units) are disposed two-dimensionally in a matrix. The structure of each nozzle unit is similar to that of the second embodiment.

As shown in FIGS. 13 and 14, eight nozzles disposed at predetermined intervals in a row in a direction approximately orthogonal to a scanning direction 41 of the inkjet recording head are arrayed in three rows in approximately the scanning direction. Individual nozzles of each row are disposed such that a nozzle in one row is shifted from a corresponding nozzle in the adjacent row by one third the predetermined interval.

According to this layout, when the nozzles are projected in the head scanning direction, the nozzles are equivalently arrayed in one row in a narrow pitch 42 of one third of the predetermined interval. As a result, it is possible to realize an artificially high-resolution head in the case of carrying out a printing, the timing of jetting ink droplets is controlled for each column while moving the head in a scanning direction. In this way, it is possible to carry out substantially the same printing as the printing when the nozzles are arrayed in one row in the head.

According to the present embodiment, when a pressure chamber having a large width with the aspect ratio approximately equal to 1 is used, it is possible to artificially realize a layout of nozzles in a narrower pitch (higher resolution) than the width of this pressure chamber. In other word, it is possible to realize an inkjet recording head of high driving efficiency and high resolution. In the present embodiment, only the nozzle layout in a matrix of 8×3 has been described. In addition to such an inkjet recording head, a separate head has also been prepared that has 780 nozzles in a layout of three units each having a matrix , layout of 26×10. It has been possible to obtain a similar affect from this. It is also possible to select a variety layouts based on a desired number of nozzles and the desired size of the head.

Fourth Embodiment

Figure 15A:
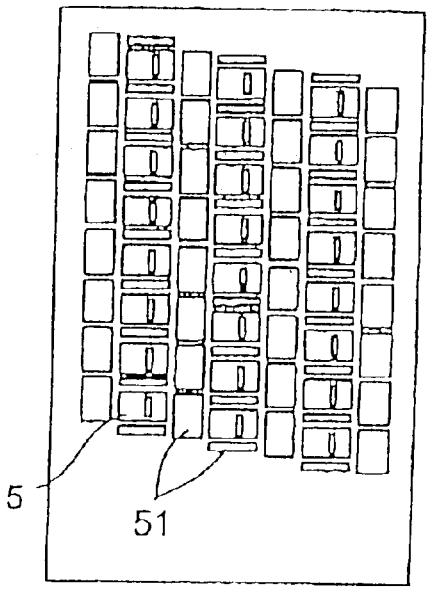
FIGS. 15A and 15B are top plan diagrams of piezoelectric actuators according to a fourth embodiment of the present invention.
Figure 15B:
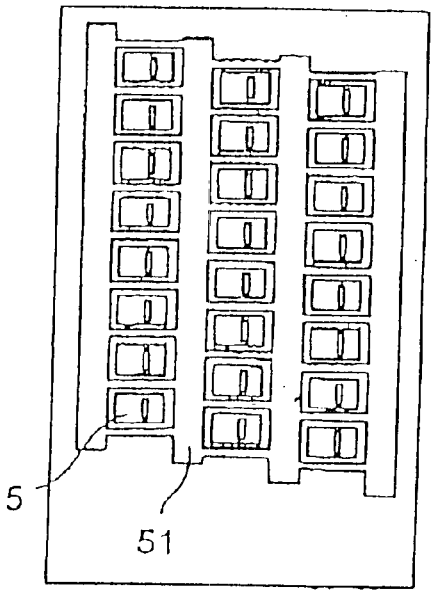

FIGS. 15A and 15B are top plan views of piezoelectric actuators according to a fourth embodiment of the present invention. As shown in these drawings each piezoelectric actuator 5 and the layout thereof are similar to those of the third embodiment. However, the forth embodiment is different from the third embodiment in that dummy patterns 51 are disposed on the periphery of a piezoelectric actuator area in which the piezoelectric actuators are laid out in a plurality of rows, and between the individual piezoelectric actuators. In the present embodiment, the width of a groove that separates each piezoelectric actuator from each dummy pattern is set to 80 $\mu$m. All other structures are similar to those of the third embodiment.

As described before, when the sandblasting is carried out, an amount of side etching is different depending on the distance between the adjacent works to be processed, and the finished measurements become different. However, according to the present embodiment, it is possible to make uniform the side etching of all the piezoelectric actuators, resulting in improved precision of the processing.

In order to check the effect of the present embodiment, the size precision of the piezoelectric actuator based on the sandblasting has been measured for the third embodiment and the fourth embodiment. As a result of such measurement, it has been confirmed that there is a variance in the size precision of ±20 $\mu$m in the third embodiment (without d dummy patterns). On the other hand, in the present embodiment where dummy patterns are disposed, the variance in the size precision is improved to ±5 $\mu$m and thus, the effect of the present invention has been confirmed.

Fifth Embodiment

Figure 16:
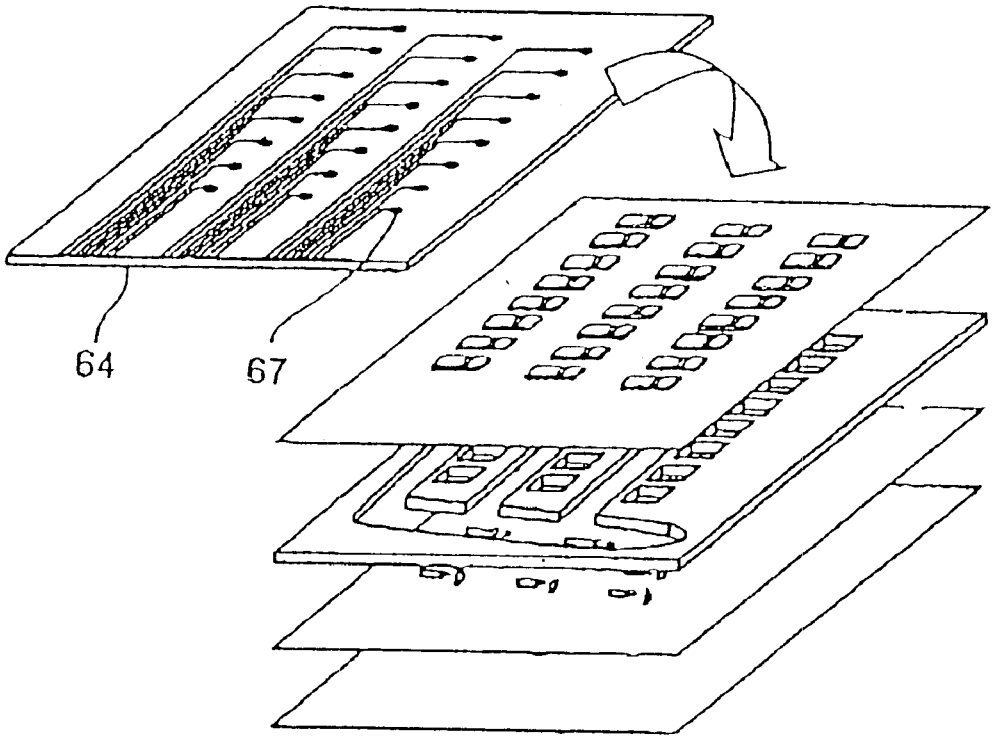
FIG. 16 is a perspective diagram showing a method of electrically connecting an inkjet recording head according to a fifth embodiment of the present invention.
Figure 17:
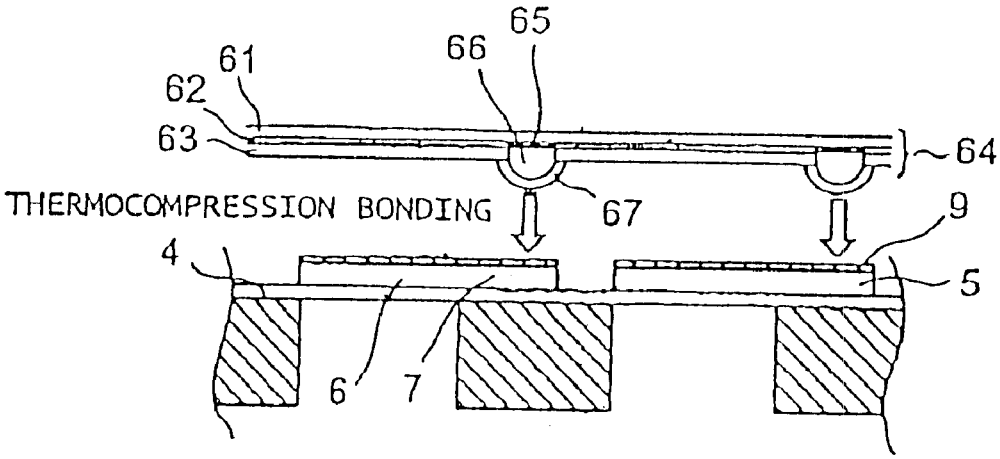
FIG. 17 is a cross-sectional diagram of two adjacent piezoelectric actuators in the fifth embodiment of the present invention.

FIG. 16 is a perspective diagram showing a method of electrically connecting an inkjet recording head according to a fifth embodiment of the present invention, and FIG. 17 is a cross-sectional view showing a portion in the vicinity of two adjacent piezoelectric actuators.

A flexible printed wiring substrate 64 consists of three layers of a polyimide base film 61 having a thickness of 25 $\mu$m, a copper signal line 62, and a polyimide cover layer 63 having a thickness of 12.5 $\mu$m. An individual, signal electrode 65 on the flexible printed wings substrate 64 is disposed corresponding to the electrode pad of each piezoelectric actuator. A bump formed with a solder 67 on the surface of a copper core 66 by electrolytic plating is formed on the individual signal electrode by heating.

The electrode pad section of each piezoelectric actuator is faced with the bump of the flexible printed wiring substrate, and they are coupled to each ether by pressure and heating. In the present embodiment, an electrical and mechanical connection is carried out by heating at a temperature 230° C. and applying pressure of 100 Mpa each in stepwise for ten seconds.

According to the present embodiment, the driving section can be formed in a structure having no electrical connection portion. Therefore, it is possible to eliminate flexure constraint due to an electrical connection portion, and increase the driving efficiency to a high level. At the same time, it is possible to eliminate the occurrence of variance in the flexure deformation due to a manufacturing error of electrical connection (in terms of an area and position of connection). Further, as the electrode pad section is disposed on the side wall of a pressure chamber having high rigidity, it is possible to prevent destruction of the electrode pad section due to the pressure on the electrode pad section in the electrical connection process and secure connection can be achieved. Therefore, a high-precision inkjet recording head having high reliability and high efficiency can be realized.

In the present embodiment, a signal line to each piezoelectric actuator exists outside the plane of each piezoelectric actuator. Therefore, it is not necessary to dispose the signal line between the actuators. As a result, the electrical connection matching a high-density inkjet recording head can be made.

Further, in the present embodiment, the bump is formed in a semi-spherical shape. Therefore, it is possible to securely effect the electrical and mechanical contact at the time of connecting each piezoelectric actuator to the electrode pad section, and further, to prevent destruction of the electrode pad section at the time of such contact. As a result of inspecting the electrical connection of each piezoelectric actuator carried out in the present embodiment, it has been confirmed that all the actuators are connected normally, and there is no destruction of piezoelectric actuators.

Further, in the present embodiment, since a core member is included in the bump, a clearance between the wiring substrate anti the driving section of the piezoelectric actuator is made. Therefore, it is possible to avoid influence on the flexure deformation of the driving section and further to dissipate heat generated when driven, with air flowing through the clearance. When actually applying a driving voltage waveform to each piezoelectric actuator, all the actuators are normally deformed in flexure. Further, it has bean confirmed that it is possible to obtain stable driving operation without deterioration in characteristic due to the heat generation when the inkjet recording head is driven continuously for a long time (e.g. 24 hours at 18 kHz).

Further, in the present embodiment, it is possible to prevent a destruction of the bump even when the head has been thermally expanded or warped due to a temperature change because the wiring substrate is made of polyimide and this wiring substrate follows the deformation of the head. In experiment, the temperature of the head was repeatedly changed between −20° C. and +40° C. 100 cycles. As a result of electric inspection, there has been no occurrence of failure.

Figure 18:
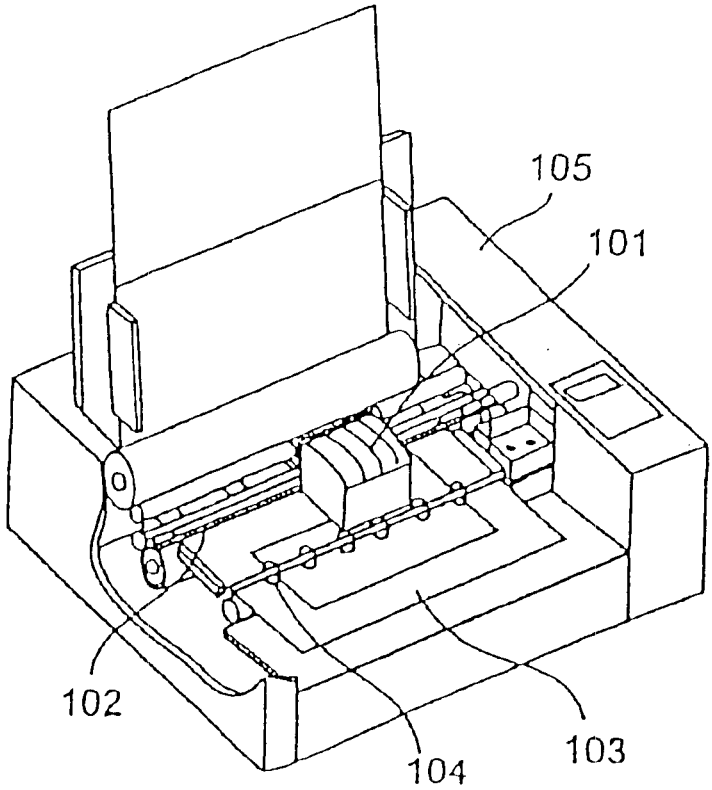
FIG. 18 is a partially broken perspective diagram showing one example of an inkjet recording apparatus that is mounted with an inkjet recording head of the present invention.

Further, as shown in FIG. 18, the inkjet recording head according to each of the above embodiments is mounted on an inkjet recording apparatus, and printing is carried out on paper. This recording apparatus is constructed of a carriage 101 composed of a head and an ink tank for supplying ink to the head, a timing, belt 102 for reciprocally moving the carriage, a roller 104 for moving paper, 103 for printing, and a casing 105. For carrying out the printing, the carriage is reciprocally moved in a main scanning direction. At the same time, ink droplets are selectively jetted, onto the paper from a plurality of nozzles of the head, while the paper is shifted in a sub-scanning direction orthogonal to the main scanning direction. With such an operation, the ink droplets are adhered onto the paper, thereby forming characters and images on the paper.

In the above first to fifth embodiments, while piezoelectric actuators are used as actuators, it is also possible to employ other driving system. For example, it is possible to use a material that has a different coefficient of thermal expansion from that of the diaphragm instead of, the piezoelectric actuators. Heat is applied to this material as a driving signal, and flexure deformation based on a difference of thermal expansion can be used. Further, a voltage may be applied to an electrode surface that is formed opposite to the diaphragm, and flexure deformation generated based on electrostatic force can be used, without connecting anything to the diaphragm.

It is needless to mention that it is possible to carry out various modifications to other portions within the technical range of the present invention. It is more preferable that Wc is 300 to 700 $\mu$m, the material of the actuator is lead-titanate-zirconate-based ceramics, and the actuator has a thickness of 15 to 40 $\mu$m, As described above, according to the present invention, the aspect ratio of the plane shape of a pressure chamber is approximately equal to 1. Therefore, it is possible to obtain larger flexure deformation than that obtained conventionally. As a result, an inkjet recording head and an inkjet recording apparatus having high driving efficiency can be realized.

Further, based on the above-described structure, the cross-sectional area of the connection portion between the bridge section and the driving section of the actuator is made smaller. With such arrangement, it is possible to reduce the constraint of the electrode pad section when the driving section deforms in flexure, allowing larger flexure deformation. As a result, it is possible to realize an inkjet recording head having higher driving efficiency.

Further, according to the present invention, the supporting condition of the periphery of the driving section is not changed even when the driving section of the actuator is slightly deviated from a predetermined position relative to the pressure chamber. Therefore, there occurs no variation in the flexure deformation. As a result, it is possible to realize a high-definition inkjet recording head. Further, according to the present invention, as the bending deformation of the bridge section itself is small, it is possible to prevent destruction of the actuator, resulting in an inkjet recording head having high reliability. By devising the plane shape of the bridge section while keeping this cross-sectional area small, it is also possible to prevent destruction of the actuator, and thus improve the reliability. Further, the actuator of the inkjet recording head according to the present invention is formed based on the sandblasting method. Therefore, it is possible to carry out precise processing easily and in a short time, even if the actuator has a complex shape. As a result, it is possible to realize high-density ink jetting at low cost.

What is claimed is:

1. An inkjet recording head comprising:

a plurality of nozzles for jetting droplets of ink;

a plurality of pressure chambers disposed for respective ones of the nozzles, wherein each of the pressure chambers has at least one wall formed as a diaphragm;

a plurality of actuators, each of which is mechanically connected to a corresponding diaphragm; and an ink supply source for supplying ink to the pressure chambers through corresponding supply paths, wherein each of the actuators comprises:

a driving section disposed in an area of a corresponding pressure chamber, wherein the driving section is deformed in flexure together with the corresponding diaphragm when a driving signal is applied;

an electrode pad section disposed in an area corresponding to a side wall of the corresponding pressure chamber, for electrical connection of the driving section to a driving signal source; and at least one bridge section connecting the driving section and the electrode pad section, wherein each of the pressure chambers has a plane shape having an aspect ratio approximately equal to 1, and the bridge section has a width of a connection area to the driving section sat smaller than a width of a connection side of the driving section.

2. The inkjet recording head according to claim 1, wherein the plane shape of each of the pressure chambers is approximately circular.

3. The inkjet recording head according to claim 1, wherein the plane shape of each of the pressure chambers is approximately a regular polygon.

4. The inkjet recording head according to claim 1, wherein the bridge section has the width of the connection area to the driving section set a half or less the width of the connection side of the driving section.

5. The inkjet recording head according to claim 1, wherein the bridge section comprises at least one bridge connected to at least one portion of the connection side of the driving section, which corresponds to near at least one position at which a deformation of the corresponding diaphragm is relatively small.

6. The inkjet recording head according to claim 3, wherein the bridge section comprises at least one bridge connected to at least one portion of the connection side of the driving section, which is distant from a center of the connection side of the driving section.

7. The inkjet recording head according to claim 3, wherein the bridge section comprises at least one bridge connected to al least one portion of the connection side of the driving section, which corresponds to near at least one corner of the regular polygon.

8. The inkjet recording head according to claim 1, wherein the connection area to the driving section is shaped in a curve.

9. The inkjet recording head according to claim 1, wherein the driving section is disposed only in an area corresponding to the corresponding pressure chamber.

10. The inkjet recording head according to claim 1, wherein a width Wp of a plane shape of the driving section is set to fall into a range: $Wp \leqq Wc-2\delta$, or $Wc+2\delta \leqq Wp$, where $\delta$ represents a positional deviation between a center position of the corresponding pressure chamber and a center position of the driving section and Wc represents a width of the plane shape of the corresponding pressure chamber.

11. The inkjet recording head according to claim 10, wherein Wp falls into a range: $Wc-2\delta)\times 0.9 \leqq Wp \leqq Wc-2\delta$.

12. The inkjet recording head according to claim 1, wherein the plurality of nozzles are arranged two-dimensionally.

13. The inkjet recording head according to claim 12, wherein the plurality of nozzles are arrayed in a plurality of rows, wherein a plurality of nozzles in each of the rows is arrayed at predetermined constant intervals.

14. The inkjet recording head according to claim 13, wherein the plurality of nozzles are arrayed in N rows in a scanning direction of the inkjet recording head, where N is a positive integer, wherein a plurality of nozzles in each of the N rows is arrayed at predetermined constant intervals in a direction approximately orthogonal to the scanning direction, wherein placement of the nozzles in each of the N rows is shifted by $1/N$ the predetermined constant interval from that of the nozzles in a subsequent one of the N rows.

15. The inkjet recording head according to claim 14, wherein the N rows are arranged at regular intervals such that each nozzle in each of adjacent rows is positioned at an intersection point of a parallelogram lattice formed by the two-dimensionally arranged nozzles.

16. The inkjet recording head according to claim 1, further comprising:

a wiring substrate including signal lines, which is disposed to cover the actuators, wherein the electrode pad section is electrically connected to a corresponding signal line of the wiring substrate by a bump.

17. The inkjet recording head according to claim 16, wherein the bump comprises a conductive core material coated with a connection material.

18. The inkjet recording head according to claim 17, wherein the conductive core material is formed like a semi-spherical shape.

19. The inkjet recording head according to claim l6, wherein the wiring substrate comprises at least a resin substrate.

20. The inkjet recording head according to claim 1, wherein each of the actuators is a piezoelectric actuator in which the driving section is a piezoelectric element.

21. The inkjet recording head according to claim 20, wherein the piezoelectric actuator is formed by applying a sandblasting method.

22. The inkjet recording head according to claim 21, farther comprising:

a dummy pattern disposed to surround a periphery of a piezoelectric actuator area where a plurality of piezoelectric actuators are arranged.

23. The inkjet recording head according to claim 21, further comprising:

a dummy pattern disposed between any two of the piezoelectric actuators within a piezoelectric actuator area where the piezoelectric actuators are arranged.

24. The inkjet recording head according to claim 22, wherein the dummy pattern is also disposed between any two of the piezoelectric actuators within the piezoelectric actuator area.

25. The inkjet recording head according to claim 22, wherein a width of a groove that separates between a piezoelectric actuator and an adjacent dummy pattern is set substantially uniform for all grooves.

26. The inkjet recording head according to claim 10, wherein a value of Wc is set to 300–700 $\mu$m.

27. The inkjet recording head according to claim 20, wherein the piezoelectric actuator is made of lead-titante-zirconate-based ceramics.

28. The inkjet recording head according to claim 20, wherein the piezoelectric actuator is 15–40 $\mu$m in thickness.

29. An actuator for deforming a diaphragm of a pressure chamber filled with ink to eject droplets of ink from a nozzle in an inkjet recording head, comprising:

a driving section disposed in an area of the pressure chamber;

an electrode pad section disposed an area corresponding to a side wall of the pressure chamber, for electrical connection of the driving section to a driving signal source; and at least one bridge section connecting the driving section end the electrode pad section, wherein the pressure chamber has a plane shape having an aspect ratio approximately equal to 1, and the bridge section has a width of a connection area to the driving section set smaller than a width of a connection side of the driving section.

* * * * *